US007103196B2

(12) United States Patent
Warren

(10) Patent No.: US 7,103,196 B2
(45) Date of Patent: Sep. 5, 2006

(54) METHOD FOR REDUCING DISTORTION IN A RECEIVER

(75) Inventor: Daniel Max Warren, Geneva, IL (US)

(73) Assignee: Knowles Electronics, LLC., Itasca, IL (US)

( * ) Notice: Subject to any disclaimer, the term of this patent is extended or adjusted under 35 U.S.C. 154(b) by 497 days.

(21) Appl. No.: 10/095,819

(22) Filed: Mar. 12, 2002

(65) Prior Publication Data

US 2002/0136425 A1 Sep. 26, 2002

Related U.S. Application Data

(60) Provisional application No. 60/275,086, filed on Mar. 12, 2001.

(51) Int. Cl.
*H04R 25/00* (2006.01)

(52) U.S. Cl. ..... 381/429; 381/429

(58) Field of Classification Search ..... 381/152, 381/369, 170–175, 190, 191, 423, 424, 425, 381/426–432, 396
See application file for complete search history.

(56) References Cited

U.S. PATENT DOCUMENTS 3,876,843 A 4/1975 Moen
3,995,124 A 11/1976 Gabr
4,020,299 A * 4/1977 Garner et al. ..... 381/432
4,815,560 A * 3/1989 Madaffari ..... 181/158
4,837,833 A 6/1989 Madaffari
5,222,050 A 6/1993 Marren et al.
5,319,717 A 6/1994 Holesha
5,452,268 A 9/1995 Bernstein
5,870,482 A 2/1999 Loeppert et al.

FOREIGN PATENT DOCUMENTS

WO WO-00/41432 7/2000

OTHER PUBLICATIONS

European Search Report for Application No. EP 02 25 1724 dated May 23, 2003.

* cited by examiner

*Primary Examiner*—Suhan Ni
(74) *Attorney, Agent, or Firm*—Marshall, Gerstein & Borun LLP

(57) ABSTRACT

A receiver, such as for use in a hearing aid, is disclosed. The receiver comprises a housing and a diaphragm assembly disposed within the housing. The diaphragm assembly acoustically divides the housing into a front volume and a back volume. The diaphragm assembly comprises a paddle having a perimeter, a flexible annulus connected to the paddle, and a diaphragm support, wherein the diaphragm support secures the perimeter of the annulus to the housing. The receiver further comprises a plurality of apertures in the diaphragm assembly, wherein the plurality of apertures provides an acoustic distortion of no greater than 2% THD.

28 Claims, 3 Drawing Sheets

METHOD FOR REDUCING DISTORTION IN A RECEIVER

RELATED APPLICATIONS

This application claims the benefit of U.S. Provisional Application No. 60/275,086, filed Mar. 12, 2001.

TECHNICAL FIELD

The present invention generally relates to an improved receiver, such as for use in a hearing aid. Specifically, the present invention relates to a receiver that incorporates a method for reducing distortion therein.

BACKGROUND OF THE INVENTION

During operation of a hearing aid, there are often instances of silence which cause the diaphragm within certain types of damped hearing aid receivers to reach a substantially stationary state. It is known in the art to include a very small number of apertures in the diaphragm in order to relieve pressure on the diaphragm resulting from barometric changes in the receiver. The air flow through these apertures, however, tends to cause distortion in some receivers. Specifically, distortion is caused by the velocity-dependent acoustic resistance of the apertures pierced in the diaphragm due to turbulence in the air flowing therethrough.

The present invention is provided to solve these and other problems and to provide other advantages. Preferred embodiments will be disclosed and the novel aspects of the present invention will be particularly identified and discussed herein.

SUMMARY OF THE INVENTION

The present invention relates to a receiver and method for reducing distortion therein.

According to one aspect of the present invention, the receiver comprises a housing and a diaphragm assembly disposed within the housing. The diaphragm assembly acoustically divides the housing into a front volume and a back volume and comprises a paddle having a perimeter, a flexible annulus connected to the paddle, and a diaphragm support. The diaphragm support secures the perimeter of the annulus to the housing. The receiver further comprises a plurality of apertures in the diaphragm assembly, wherein the plurality of apertures provides an acoustic distortion of no greater than 2% THD.

According to another aspect of the present invention, at least thirty-five apertures are provided in the diaphragm assembly.

According to still another aspect of the present invention, the diameter of each of the plurality of apertures is between 0.001 inches and 0.0007 inches.

According to yet another aspect of the present invention, a method of reducing distortion in a receiver is provided. The method comprising the steps of providing a receiver comprising a housing and a diaphragm assembly disposed within the housing, wherein the diaphragm assembly acoustically divides the housing into a front volume and a back volume. The diaphragm assembly has a paddle having a perimeter, a flexible annulus connected to the paddle, and a diaphragm support, and the diaphragm support secures the perimeter of the annulus to the housing. The method further comprises the step of piercing the diaphragm assembly such that a plurality of apertures are provided therein, wherein the plurality of apertures provides an acoustic distortion of no greater than 2% THD.

Other features and advantages of the invention will be apparent from the following specification taken in conjunction with the following drawings.

In order that the present invention may be more fully understood, it will now be described by way of example, with reference to the accompanying drawings in which.

DETAILED DESCRIPTION OF THE PREFERRED EMBODIMENT

Figure 1:
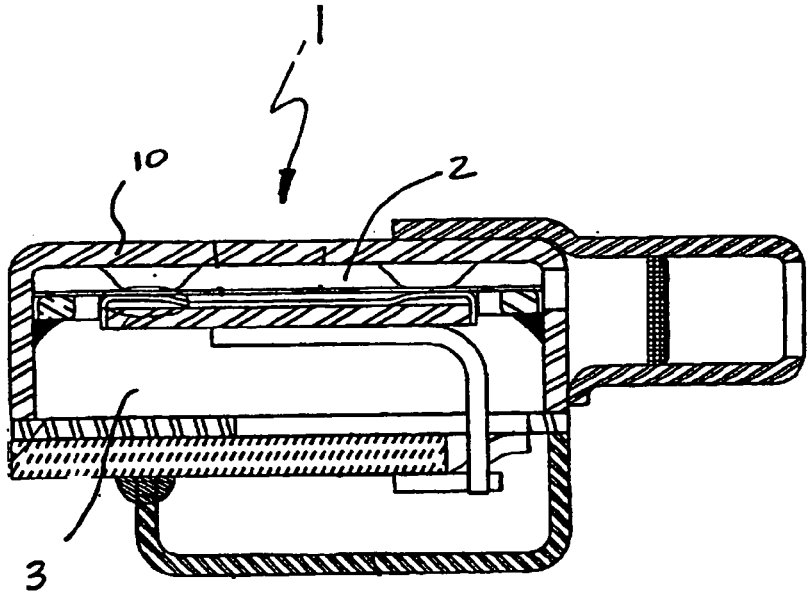
FIG. 1 PRIOR ART
FIG. 1 is a cross-sectional side view of a conventional receiver for a hearing aid.

While this invention is susceptible of embodiment in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated.

According to the present invention, the acoustic distortion caused by turbulence through diaphragm apertures can be reduced relative to current state of the art by providing a greatly increased number of uniform, smaller apertures in such proportion that the acoustic response of the receiver remains essentially unchanged. By increasing the number of apertures, the flow rate through each aperture is reduced. The aperture sizes are reduced to compensate for their increased number. Due primarily to thermal and viscous effects, the combined area of the smaller apertures may be several times the original combined area. As an example, distortion reduction of more than 2% THD has been achieved by reducing the individual aperture diameter by 25 to 50%, and increasing their number by a multiplier of eight.

With laminar flow, acoustic resistance is a constant value equal to the ratio of pressure to flow rate. With turbulent flow, the resistance increases with flow as the aperture "chokes up" with turbulence, thereby reducing the effective area of the aperture. By the proper selection of aperture size and number, the range of laminar flow and linear resistance can be extended to cover most or all of the pressures seen in nominal operation of the receiver. Further, the linear resistance of the laminar region can be made to match the rate of change of pressure to flow rate in the nonlinear, turbulent region, thereby reducing distortion when the receiver is operated beyond nominal operating levels.

Figure 2:
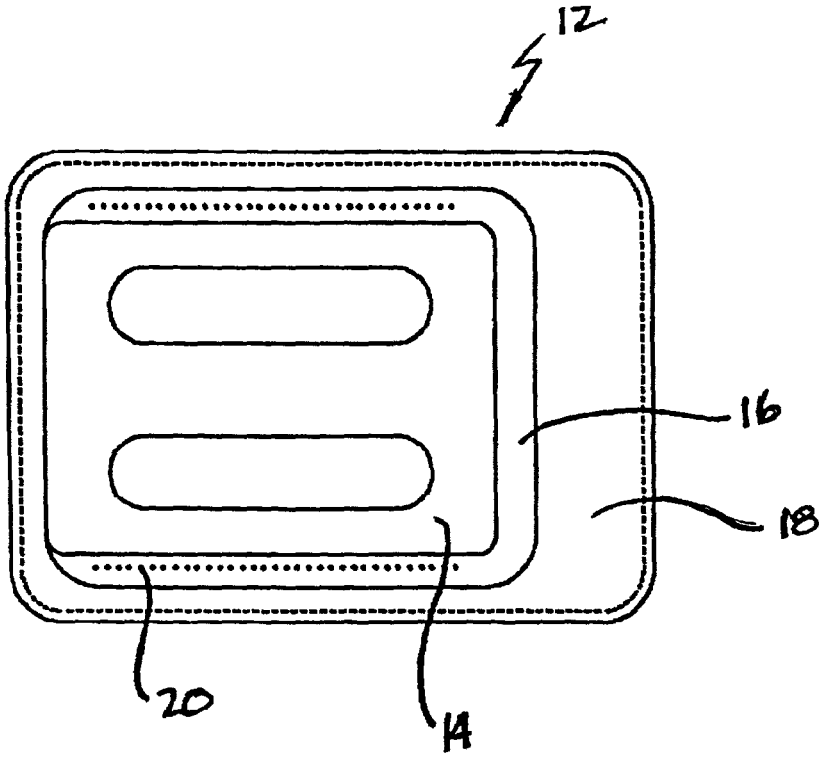
FIG. 2 is a top view of a diaphragm assembly according to the present invention in which apertures are pierced in the annulus of the diaphragm assembly.
Figure 3:
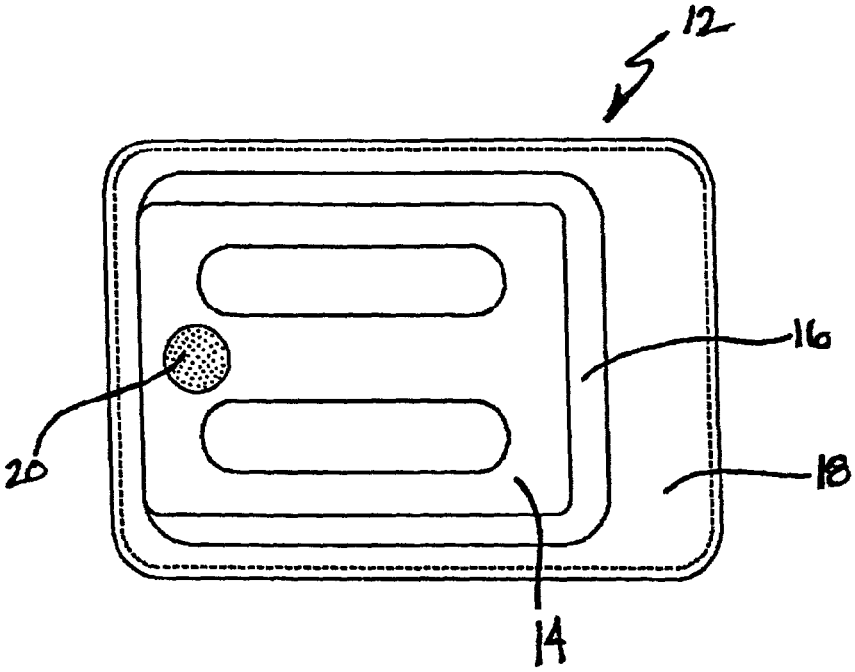
FIG. 3 is a top view of a second embodiment of a diaphragm assembly according to the present invention in which apertures are pierced in the paddle of the diaphragm assembly; and, FIG. 4 is a top view of a third embodiment of a diaphragm assembly according to the present invention in which apertures are pierced in the diaphragm support of the diaphragm assembly.
Figure 4:
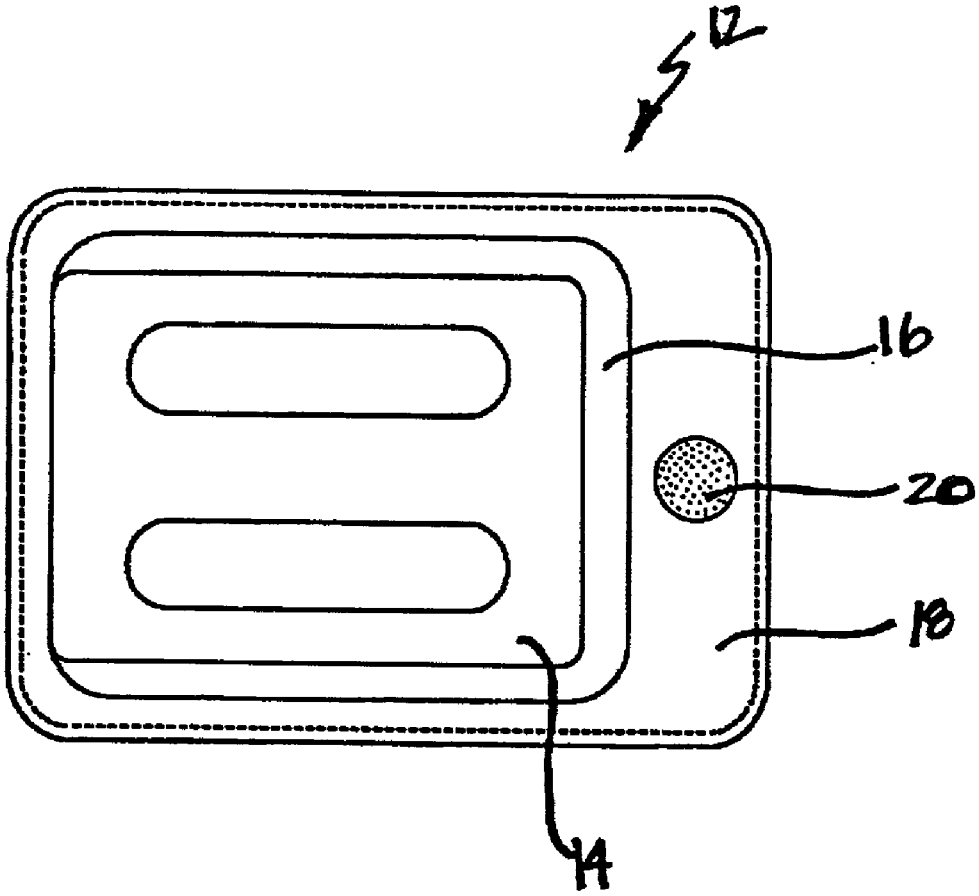

FIGS. 2–4 illustrate different embodiments of a receiver according to the present invention. Generally, the receiver 1 is comprised of a housing 10 and a diaphragm assembly 12. The diaphragm assembly 12 acts to acoustically divide the housing into a front volume 2 and a back volume 3. The diaphragm assembly 12 is comprised of a paddle 14, a flexible annulus 16 connected to the paddle 14 and a diaphragm support 18 for securing the perimeter of the annulus 16 to the housing. The remaining components may be those of any receivers known in the art which are generally used in connection with hearing aid devices such as the device illustrated in FIG. 1.

According to the present invention, the diaphragm assembly 12 has a plurality of apertures 20 therein. While a relatively large quantity of apertures 20 is pierced in the diaphragm assembly 12, each one of the plurality of apertures 20 is relatively small in diameter. As discussed below, the relative number of apertures 20, when taken in conjunction with their size, acts to reduce acoustic distortion in the receiver by at least 2% relative to the current state of the art at nominal operation levels.

In the preferred embodiment, the annulus 16 is generally made from a flexible material such as polyurethane or the material sold under the tradename Mylar®. However, it is contemplated that the annulus 16 be made from any flexible material suitable for acoustically sealing the front and back volumes 2, 3 of the receiver 1. The paddle 14 is usually made from aluminum and may be either secured to the annulus 16 at the perimeter of the paddle 14 or attached to a generally solid piece of material which forms the annulus 16. It is contemplated that the paddle 14 be formed from any material suitable for such applications. The diaphragm support 18 is a stationary portion of the diaphragm assembly 12, and acts to support the flexible structure comprised of the annulus 16 and paddle 14.

In a prior art receivers, approximately five apertures of a diameter slightly larger than 0.001" are pierced in the diaphragm. According to the present invention, however, approximately thirty-five apertures 20, each being approximately 0.0007" in diameter are pierced in the diaphragm to match the desired damping in the acoustic resonance. In the present invention, the apertures 20 may be disposed anywhere in the diaphragm assembly 12 that represents an acoustic path between the front and back volumes 2, 3. For example, as seen in FIGS. 1 and 3, the apertures 20 may be pierced in the annulus 16 or the stationary diaphragm support 18. Alternatively, as depicted in FIG. 2, the apertures 20 may be pierced in the paddle 14. In the instances in which the paddle 14 or diaphragm support 18 are pierced, the apertures 20 may be pierced through a thin material adhered over a large hole in the paddle 14 or diaphragm support 18, or the apertures 20 may comprise an acoustic damping screen.

While specific embodiments have been illustrated and described, numerous modifications come to mind without significantly departing from the spirit of the invention, and the scope of protection is only limited by the scope of the accompanying Claims.

What is claimed is:

1. A receiver comprising:

a housing;

a diaphragm assembly disposed within the housing, the diaphragm assembly acoustically dividing the housing into a front volume and a back volume, the diaphragm assembly comprising:

a paddle having a perimeter;

a flexible annulus connected to the paddle; and, a diaphragm support, wherein the diaphragm support secures the perimeter of the annulus to the housing; and, a plurality of apertures in the diaphragm assembly, wherein the plurality of apertures provides an acoustic distortion of no greater than 2% THD.

2. The receiver of claim 1, wherein the plurality of apertures in the diaphragm comprises at least 35 apertures.

3. The receiver of claim 1, wherein each of the plurality of apertures has a predetermined diameter between 0.001 inches and 0.0007 inches.

4. The receiver of claim 1, wherein the plurality of apertures are disposed in the flexible annulus.

5. The receiver of claim 1, wherein the plurality of apertures are disposed in the diaphragm support.

6. The receiver of claim 1, wherein the paddle includes a through-hole and wherein the plurality of apertures are disposed within the through-hole.

7. A receiver comprising:

a housing;

a diaphragm assembly disposed within the housing, the diaphragm assembly acoustically dividing the housing into a front volume and a back volume, the diaphragm assembly comprising:

a paddle having a perimeter;

a flexible annulus connected to the paddle; and, a diaphragm support, wherein the diaphragm support secures the perimeter of the annulus to the housing; and, a plurality of apertures in the diaphragm assembly, wherein each of the plurality of apertures has a predetermined diameter and wherein the apertures are sufficiently large in quantity and sufficiently small in diameter to provide an acoustic distortion of no greater than 2% THD.

8. The receiver of claim 7, wherein the plurality of apertures in the diaphragm comprises at least 35 apertures.

9. The receiver of claim 8, wherein the diameter of each of the plurality of apertures is no greater than 0.0007 inches.

10. The receiver of claim 8, wherein the diameter of each of the plurality of apertures is between 0.001 inches and 0.0007 inches.

11. The receiver of claim 7, wherein the plurality of apertures are disposed in the flexible annulus.

12. The receiver of claim 7, wherein the plurality of apertures are disposed in the diaphragm support.

13. The receiver of claim 7, wherein the paddle includes a through-hole and wherein the plurality of apertures are disposed within the through-hole.

14. A receiver comprising:

a housing;

a diaphragm assembly disposed within the housing, the diaphragm assembly acoustically dividing the housing into a front volume and a back volume, the diaphragm assembly comprising:

a paddle having a perimeter;

a flexible annulus connected to the paddle; and, a diaphragm support, wherein the diaphragm support secures the perimeter of the annulus to the housing; and, a plurality of apertures in the diaphragm assembly, wherein the plurality of apertures provides an acoustic distortion of no greater than 2% THD and each of the plurality of apertures has a predetermined diameter of no greater than 0.0007 inches.

15. The receiver of claim 14, wherein the plurality of apertures in the diaphragm comprises at least 35 apertures.

16. The receiver of claim 14, wherein the plurality of apertures are disposed in the flexible annulus.

17. The receiver of claim 14, wherein the plurality of apertures are disposed in the diaphragm support.

18. The receiver of claim 14, wherein the paddle includes a through-hole and wherein the plurality of apertures are disposed within the through-hole.

19. A receiver comprising:

a housing;

a diaphragm assembly disposed within the housing, the diaphragm assembly acoustically dividing the housing into a front volume and a back volume, the diaphragm assembly comprising:

a paddle having a perimeter;

a flexible annulus connected to the paddle; and, a diaphragm support, wherein the diaphragm support secures the perimeter of the annulus to the housing; and a plurality of apertures in the diaphragm assembly, wherein each of the plurality of apertures has a diameter less than 0.001 inches whereby the plurality of apertures provides a decrease in acoustic distortion.

20. The receiver of claim 19, wherein each aperture of the plurality of apertures has a diameter of at least 0.0007 inches.

21. The receiver of claim 19, wherein each aperture of the plurality of apertures has a diameter of at most 0.0007 inches.

22. The receiver of claim 19, wherein each aperture of the plurality of apertures has a diameter of at most 0.00075 inches.

23. The receiver of claim 19, wherein the plurality of apertures in the diaphragm comprises at least 35 apertures.

24. A receiver comprising:

a housing;

a diaphragm assembly disposed within the housing, the diaphragm assembly acoustically dividing the housing into a front volume and a back volume, the diaphragm assembly comprising:

a paddle having a perimeter;

a flexible annulus connected to the paddle; and a diaphragm support, wherein the diaphragm support secures the perimeter of the annulus to the housing; and, at least 35 apertures in the diaphragm assembly, whereby the at least 35 apertures provide a decrease in acoustic distortion.

25. The receiver of claim 24, wherein each aperture of the at least 35 apertures has a diameter less than 0.001 inches.

26. The receiver of claim 25, wherein each aperture of the at least 35 apertures has a diameter of at least 0.0007 inches.

27. The receiver of claim 25, wherein each aperture of the at least 35 apertures has a diameter of at most 0.0007 inches.

28. The receiver of claim 25, wherein each aperture of the at least 35 apertures has a diameter of at most 0.00075 inches.

* * * * *